United States Patent [19]

McClintock

[11] Patent Number: 5,035,518

[45] Date of Patent: Jul. 30, 1991

[54] HINGE PRESSURE SENSITIVE ADHESIVE TAB CLOSURE FOR PACKAGE

[75] Inventor: Jack M. McClintock, Pittsburgh, Pa.

[73] Assignee: Morgan Adhesives Company, Ohio

[21] Appl. No.: 481,492

[22] Filed: Feb. 16, 1990

[51] Int. Cl.[5] ..... B65D 33/16

[52] U.S. Cl. ..... 383/70; 383/66; 383/78; 383/81; 383/86; 229/123.1; 206/621; 206/621.7; 206/630; 206/631.1; 206/632; 206/633

[58] Field of Search ..... 383/59, 62, 66, 70, 383/71, 78, 81, 82, 83, 86, 89; 229/123.1, 125.15; 206/607, 620, 621, 621.7, 630, 631, 631.1, 632, 633

[56] References Cited

U.S. PATENT DOCUMENTS

| | | | |
|---|---|---|---|
| 2,349,247 | 5/1944 | Coghill | 383/93 |
| 2,480,500 | 8/1949 | Moore | 383/93 X |
| 3,154,239 | 10/1964 | Madsen | 383/81 |
| 3,711,011 | 1/1973 | Kugler | 383/66 X |
| 4,348,440 | 9/1982 | Kriozere | 383/78 X |
| 4,543,139 | 9/1985 | Freedman et al. | 383/86 X |
| 4,709,399 | 11/1987 | Sanders | 383/66 |
| 4,785,940 | 11/1988 | Wilson | 383/78 X |
| 4,840,270 | 6/1989 | Caputo et al. | 383/66 X |
| 4,902,141 | 2/1990 | Linnewiel | 383/89 X |
| 4,911,563 | 3/1990 | Ciani | 363/89 |

*Primary Examiner*—Stephen Marcus
*Assistant Examiner*—Jes F. Pascua
*Attorney, Agent, or Firm*—Oldham & Oldham Co.

[57] ABSTRACT

This invention relates to a hinge type pressure sensitive resealable closure system for a container. The invention comprises an essentially flat strip of suitable material that is permanently adhered at one surface to the container, such adherence normally by a permanent pressure sensitive adhesive, but it could be heat sealed or otherwise attached to the container in a permanent manner. Another surface of the strip is adapted by virtue of a removable pressure sensitive adhesive to be repeatedly removably attached to the container with the respective permanent and removable attachments closing the container in a repeatable resealable mode. The strip can include printing thereon, and other suitable surfaces could include more removable pressure sensitive adhesive for various more sophisticated closure techniques. The strip is provided with a hinge mechanism between the two surfaces thereby allowing the two surfaces to move relative to each other to be in different planes, thus allowing the strip to go around corners or be folded back on itself to effect different types of closure techniques for various containers.

19 Claims, 11 Drawing Sheets

HINGE PRESSURE SENSITIVE ADHESIVE TAB CLOSURE FOR PACKAGE

TECHNICAL FIELD

The present invention relates to a flexible container which may be reclosed using a reclosable closure system. More specifically, this invention relates to flexible bags, boxes, or similar containers having a novel adhesive strip thereon enabling an open end of the container to be secured to maintain closure of the container using the novel hinge strip of the invention. The strip preferably utilizes a removable adhesive which may be used multiple times to close the container and allows easy and effective closure of such flexible containers and bags. The strip is a unique hinge type closure wherein one side is permanently attached to the container and the other side has a tab and a removable adhesive adapted to be releasably secured to the container or bag when the tab grasped and the releasable adhesive is pressed into contact with the container so as to effect a closure. A unique feature of the invention is the ability to print on the shield permanent side as well as on the non-pressure sensitive adhesive surface of the strip so as to have permanent printing always associated with the closure system.

BACKGROUND OF THE INVENTION

There is known in general in the prior art a number of methods for protecting the contents of a container through the use of a reclosable closure. More particularly, these types of closure systems are adapted for potato chip bags, cereal bags, bread bags, or the like, and usually the bag itself is a plastic or coated paper system which is flexible and may easily be twisted or manipulated; and for rigid containers such as cereal and detergent boxes.

One of the most widely used methods for resealing or reclosing a flexible container involves a use of a separate component such as a metal wire twist tie which is covered with paper, or a plastic clip. These are typical methods for closing a loaf of bread. These methods, however, have several disadvantages due to the fact that the reclosable seals are not part of the container. The plastic clips or twist ties may often be misplaced between uses and also require some degree of fine motor control, therefor making their use difficult for the young, elderly, and the physically handicapped. Additionally, after repeated use, plastic clips often break and the twist ties expose their metal wires making their use potentially hazardous. These closures may also pose a risk of choking or other hazards for small children who may have access to them. These types of closures can also cause tears in the container.

Another known construction utilizes zip lock ®, and similar zipper-like sealing means to provide the containers with the reclosable air tight seal. This construction adds substantially to the cost of the container and adds difficulty to its manufacture. Furthermore, these systems also require some fine motor control which may prove difficult again for the young, elderly or physically handicapped.

Previous attempts at developing reclosable sealing means involving pressure sensitive adhesives were largely unsuccessful or unnecessarily complex. Many resealable systems were unreliable in that after a limited number of reclosures, the seal would often fail to further adhere, or in other words, the pressure sensitive adhesive would lose its tack. Other systems require components which had to be manufactured using methods of die cutting or other off line processes thereby prohibitively raising the cost thereof.

One example of a reclosing system is shown in U.S. Pat. No. 4,552,269, which discloses a resealable device consisting of a paper or foil blank in a sealing flap. While this is an improvement over prior resealable devices, this device still requires production through die cutting means and provides only a limited size opening which can be resealed. Another system is shown in U.S. Pat. No. 4,584,201, which shows use of an adhesive strip positioned parallel to a top sealed edge of the bag. The top edge can be folded upon itself and then adhered to the strip to effect a closure.

One other closure system after which the instant invention is designed but is believed to represent an improvement thereover, is that shown in patent application Ser. No. 413,951, filed Sept. 28, 1989, by Kurt M. Schramer, for "A Reclosable Flexible Container and Method of Reclosing". The instant system is believed to represent an improvement thereover, because it is simpler to manufacture and apply, it allows advertisement as well as instructions for use associated with the closure throughout its useful life so as to give good promotional and use characteristics, and it is simple and effective to use.

SUMMARY OF THE INVENTION

Therefore, it is an object of the present invention to provide an inexpensive means for closing a bag, package, box or the like used to contain a loaf of bread, or cereal, or crackers, or baby wipes, or the like.

It is also an object to provide a means for closing the bread bag or other containers, bags, boxes, etc. which is reliable and can easily be used a multiple of times without failing to seal.

It is also an object of the invention to provide a means for closing the bag or other container which allows printing on the face shield of the adhesive strip associated with the invention, and which printing will always be present because the face shield or strip is permanently attached to the bag or other container.

It is also an object of the invention to provide a means for closing a bread bag which can be used or adapted for use on a large number of different types of bags or flexible and rigid containers.

It is also an object of the invention to provide a means for closing a bread bag such that it uses a removable adhesive which will maintain a closure when placed at a plurality of different spots on the bread bag itself.

It is a further object of the invention to provide the means for closing of the bag or other container which is designed to protect the pressure sensitive adhesive closure mechanism from contamination such as crumbs, dirt or other ingredients in the bag or container being closed so that the pressure sensitive adhesive will not lose its tack or ability to stick to achieve the closure desired.

It is a further object of this invention to provide a means for closing a bread bag and other flexible and rigid containers which is simple to use and requires a minimal amount of motor control or consumer education.

It is a further object of this invention to provide a means for closing a bread bag wherein the closure strip can be attached to the containers as a part of an in-line manufacturing of the product prior to its functional use with the bread or other products deposited therein.

These and other objects may be accomplished with the present invention which comprises a suitable bag, box or container for holding the product, such bag having at least one open end. The bag includes a reclosing strip shield having first and second surfaces which is positioned on the bag, and wherein the first surface contacts and bonds with the bag having a permanent adhesive strength, the first and second surfaces being on one side of the strip with an uncoated barrier between the adhesive surfaces whereby the strip can be bent on the uncoated area to expose the second surface to hold the bag in a closed position when the open end is pulled down to close the bag when the second adhesive surface is attached to the bag. Normally, the second adhesive surface includes a release liner to protect the adhesive thereon until the actual use of the second adhesive surface is required, and wherein such second adhesive surface is a removable adhesive. The invention also includes printing on the permanent stock face and/or shield of the strip for advertising, promotional or instructional purposes, such printing to be exposed whenever the bag container, etc. is opened, and folded back on itself in the closing configuration.

BRIEF DESCRIPTION OF THE DRAWINGS

Reference should be made to the accompanying drawings wherein;

FIG. 22 is a cross-sectional elevational showing of a hinge strip having a permanent adhesive on one side and printing opposite, and removable adhesive in opposed relationships on the other end of the strip with the hinge in between;

DETAILED DESCRIPTION OF THE PREFERRED EMBODIMENT

Figure 1:
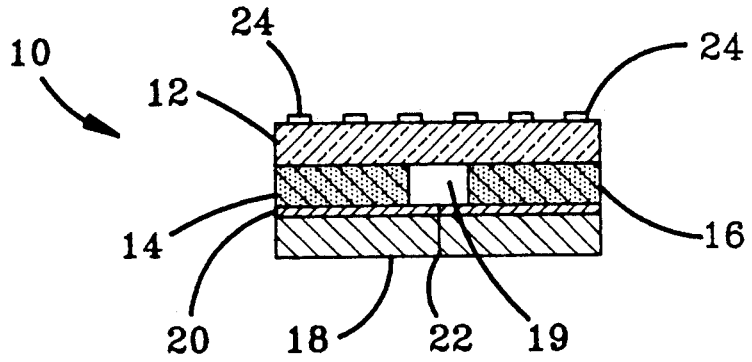
FIG. 1 is an end elevational, cross-sectional view of a preferred embodiment of the hinge type closure comprising a preferred embodiment of the invention.

Referring now to the drawings of FIG. 1 illustrates a preferred embodiment of the invention which incorporates a closure strip indicated generally by numeral 10 which incorporates a face material and/or shield 12 having a split pressure sensitive adhesive coating adhered thereto comprising a permanent adhesive 14 and a removable adhesive 16, these being adhered to the face stock or face layer and/or shield 12. A release liner 18 is removably attached to both pressure sensitive layers 14 and 16 by means of a silicone release coating 20, all in a manner well understood by one skilled in the art. Preferably, in order to have this closure strip function in the way preferred by the invention, the release liner 18 is slit at line 22 so that the section of the release liner covering the permanent adhesive 14 may be removed separately in machine application from that portion of the release liner covering the removable pressure sensitive layer 16. The release liner 16 is protected by the facing layer and/or shield 12.

The preferred strip 10 of the invention will include printing 24 on the face, which may be instructions or advertising or promotional material, or the like. Since the strip is permanently bonded to the container, the printing is always present. The face stock 12 may be paper, plastic, vinyl or any other suitable material, and may have some stiffness for particular applications.

Figure 2:
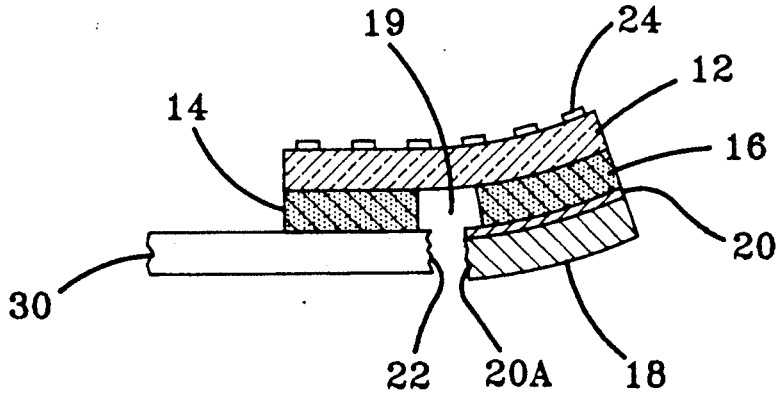
FIG. 2 is a similar cross-sectional elevation of the strip of FIG. 1 with one side of the adhesive system permanently attached to the bag material and the second side in position for actuation to act as a closure system.

The permanent adhesive layer 14 is designed to have a permanent adherence to the bag material or container to which it will be applied, and in use, as seen in FIG. 2, the release liner 18 and silicone coating 20 will be removed and split along the line 22, and then adhered to the bag or container in the form illustrated in FIG. 2. Normally, this will be done by an automatic operation through suitable machinery, and to prepare the bag with the sealing strip in place prior to inserting any material into the bag such as a loaf of bread or the like. Hence, it should be seen in FIG. 2 that the release liner 18 is still in place on the removable adhesive side. An exposed end 20*a* forms an easy release tab which when the face stock is bent up facilitates a manual removal of the release liner 18 from the removable side when it is desired to do that. It can be done with gloves.

Figure 7:
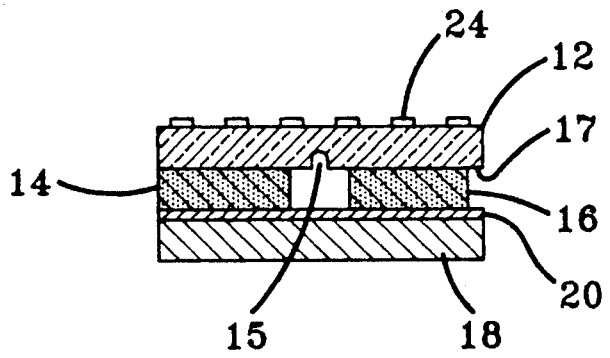
FIG. 7 is an end elevational, cross-sectional view of an alternate embodiment of the hinge type closure with hinge means formed in the closure and a lift tab along one side thereof, and a continuous release liner.
Figure 8:
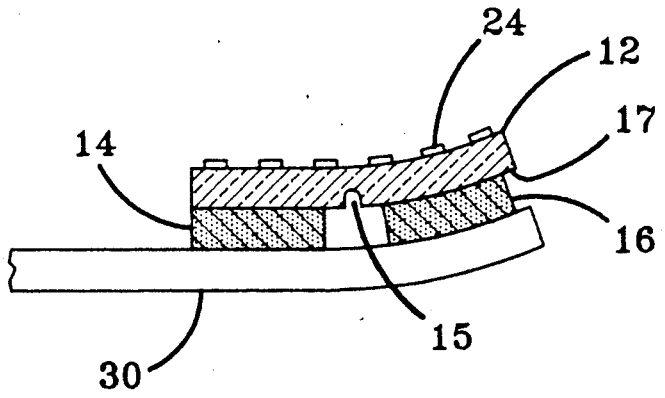
FIG. 8 is a similar cross-sectional elevation of the strip of FIG. 7 with one side of the adhesive system permanently attached to the container material and the second side releasably secured to the container material for subsequent use.
Figure 9:
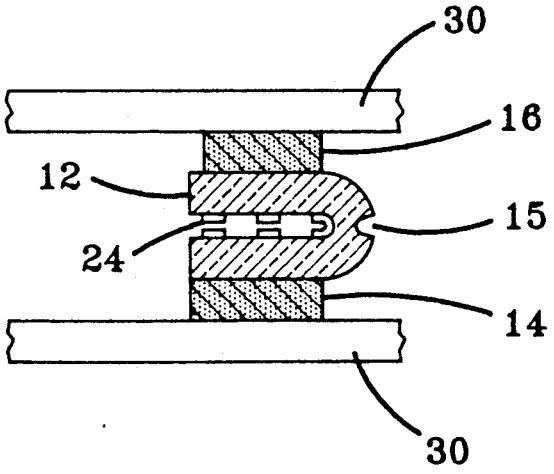
FIG. 9 is the strip of FIG. 8 with its releasable end detached from its initial position as shown in FIG. 8 and in its operative closure position showing the hinged folded back relationship to provide the closure from permanent adhesive on one side of the container to removable adhesive attached to another portion of the container.

In some instances, it may be desirable to not utilize the slit 22 and to simply strip the entire release liner 16 during the machine application and press both the permanent adhesive 14 and the removable adhesive 16 into position on the bag or container as shown in FIG. 8, thus assuring that the removable pressure sensitive adhesive layer 16 will not be contaminated, nor the release liner 18 cause any interference with the filling of the bag or other machine operations associated with the automatic handling of the bag or container during further processing. In other words, with the release liner 20 over the removable pressure sensitive adhesive actually removed during the application, the removable pressure sensitive adhesive can still be lifted in to operable position, particularly because of the release tab outer identified by numeral 17 as seen in FIGS. 7 through 9.

Figure 3:
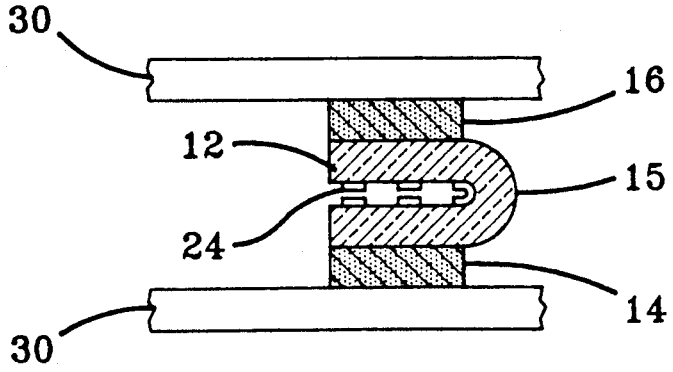
FIG. 3 is the strip of FIG. 2 in the operative closure position showing the hinged folded back relationship to provide the closure from permanent adhesive on one side of the bag or container to removable adhesive attached to another portion of the bag.

Referring to FIGS. 1–3, it should be understood that the attachment of the strip 10 by the permanent adhesive 14 allows the face stock and/or shield 12 to protect the other liner 18 to cover the removable adhesive 16 during mechanical processing when the strip is attached to the bag, as well as during filling of the bread or other materials into the bag, so the liner half 18 is not inadvertently stripped off before it is intended to be stripped by the end user. Also, of course, the instructions provided by the printing 24 will always be present thus giving an instruction reminder to the user of how to use the closure system during its repeated use.

Figure 10:
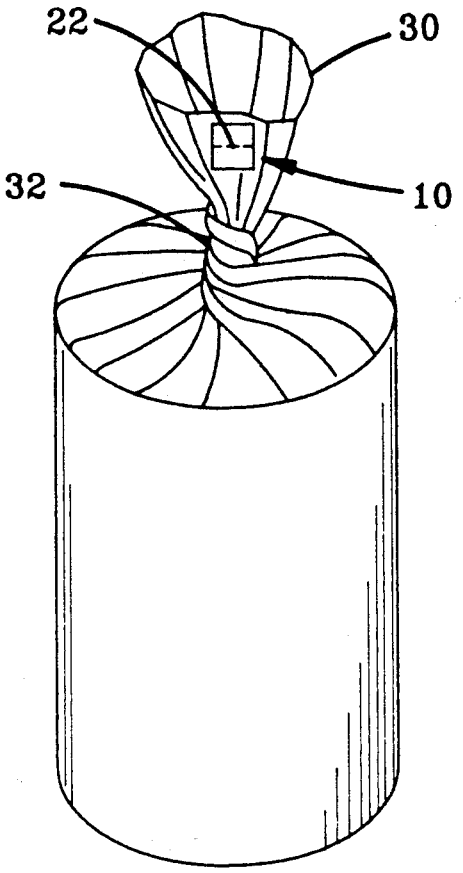
FIG. 10 is a perspective view illustrating the positioning of the closure strip on the bag in one location.

The operability of the system is illustrated in FIG. 3 where one will manually open the hinge area of the face stock back on itself from about 20° to about the 180 degree relationship illustrated. This arrangement allows removal by the tab 20*a* popping out of the ungummed area 19. Using the tab 20*a*, one then removes the release liner, exposing the removable adhesive layer 16 which will be attached to the bag material in the manner better illustrated in FIGS. 10 and 11 of the drawings. Specifically, referring to FIGS. 10, the strip 10 is illustrated as being attached to the top end of a bag 30 with the permanent adhesive area 14 preferably being towards the open end of the bag 30, and the slit edge 22 being substantially parallel to the edge of the opening of the bag 30. The illustration in FIG. 10 shows the strip in the same configuration as in FIG. 2.

Figure 11:
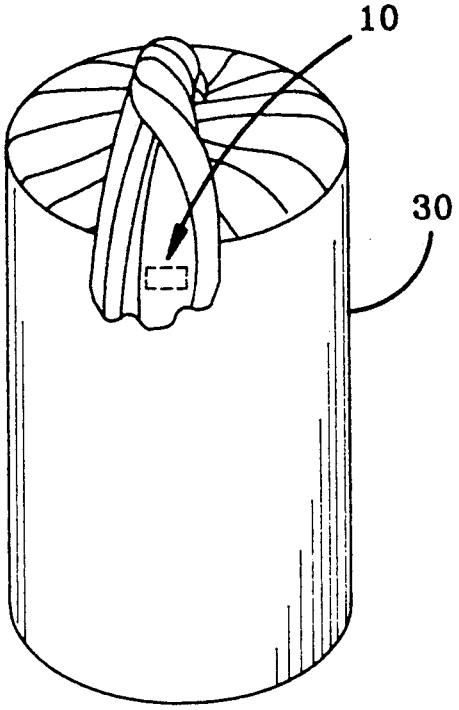
FIG. 11 illustrates an arrangement for positioning the twisted top of the bag over the top edge of the bag to be secured along the side of the bag.

Now, in order to understand the operation of the system (see FIGS. 10 and 11), one must envision picking the bag 30 up in one hand and twisting it so as to form the slightly knotted bunched up portion 32, then lifting up the lower edge of the strip 10, removing the release liner 20, and folding the strip back along itself so as to effect a hinge relationship at the ungummed area 19, as seen in FIG. 2, between the permanent and removable pressure sensitive adhesive. Then the open end of the bag 30 is folded down allowing the exposed removable pressure sensitive adhesive layer 16 to adhere to the bag 30 where indicated, which results in the configuration of FIG. 3, and effectively folds the face stock on itself with the printing in the back to back relationship shown in FIG. 3. Note that the strip 10 shown in the chain dotted line of FIG. 11 is only half the size as in FIG. 10 because of the hinged back relationship.

Naturally, when one wants to open the bag they simply grab the folded down end of the bag and pull to release the releasable adhesive 16 from the bag material 30 which tends to cause the face stock to spring back to essentially a flat relationship again, thus exposing the printing, which might include instructions, advertising or promotional material or the like, and the face stock acts as a shield to protect the removable adhesive. The ungummed or non-adhesive area 19 acts as a separation between the permanent and removable pressure sensitive adhesive areas 14 and 16 and is important to the functioning of the strip 10 because, as the strip is grasped and the removable area is peeled from a position of adherence to the bag or container, toward a position of non-adherence, the strip snaps across the non-adhesive area to serve as an indication of sufficient peeling of the removable area from the bag or container. The same procedure is followed of twisting the top, folding the face stock back on itself and effecting the seal as bread is used from the loaf, or other ingredients are taken from the package reducing the quantity of the material in the package or bag itself. Because the removable adhesive has the characteristic to simply stick, in a removable manner to the bag material, it is easy to open the bag and reclose it many many times. In some instances to prevent contamination of the removable adhesive by bread crumbs, sugar, flour, handy disposable baby wipes or the like, it is preferable to always stick the removable adhesive portion of the strip back to the bag whether it is in the opened or closed position. Hence the removable tab is pressed into position to prevent it from getting contaminated.

FIG. 8 illustrate the removable adhesive portion of the strip in a sealed position to the container as initially applied. In this mode a release tab 17 is designed on the outer edge of the removable adhesive. In many instances this may be preferable since the removable liner 18 of FIG. 2 can catch on the machinery which fills the bag causing operating problems.

The respective terms, "permanent pressure sensitive adhesive" and "removable pressure sensitive adhesive" are used in their well known, art-recognized meanings. A permanent adhesive is one which forms a strong bond with the substrate to which it is applied, so that neither the adhesive nor any adherence surface (other than a release coated backing such as a silicone liner) can be used without damage. A removable pressure sensitive adhesive, on the other hand, is one which can be peeled off, together with the backing to which it is applied, from a substraight surface without damage to either the adhesive or the backing. In other words, in the instant situation, the removable adhesive will stay adhered to the face stock 12, but will easily remove from the bag material 30.

Representative removable pressure sensitive adhesives are those well known acrylic emulsions described in the following U.S. Pat. Nos.: 3,922,464, Spencer Silver et al, 4,645,711, Richard E. Bennet et al, 4,629,663, Francis W. Brown et al, and 4,599,265, Donald L. Emsay. These patents are incorporated herein by reference.

The earliest of these removable pressure sensitive acrylic emulsion adhesive patents (Silver et al.) comprises:

(a) a copolymer of from 88 to 99 parts by weight of at least one terminally unsaturated vinyl monomer, with 70–100% by weight of said vinyl monomer being a non-tertiary alkyl acrylate, each alkyl group having at least half its carbon atoms in a straight chain and having usually 4 to 12 carbon atoms;

(b) from 0.2 to 5 parts by weight of at least one vinyl unsaturated, homopolymerizable emulsifier monomer which is a surfactant having both hydrophobic and hydrophilic moieties and optionally may contain from 0 to 10 parts by weight of at least one Zwitterion monomer.

The Bennett et al. patent is an improvement on the Silver et al. patent and uses tackifier resin in amounts of 5–50% by weight, such as hydrogenated resin ester, polyterpene, polymerized alkyl styrene and polymerized petroleum-derived monomer resins to give the removable pressure sensitive adhesive better resistance to lifting forces at elevated temperatures while also being cleanly removable.

The Brown et al. patent teaches how to make removable pressure sensitive adhesives of the type used as automotive masking tape. The Esmay patent produces removable pressure sensitive adhesive from an alkyl acrylate polymer of low tack but sufficiently tacky to adhere to ordinary substrates by being cross-linked and nearly free of polar substituents. Thus, by adjusting the degree of cross-linking, the pullback or tack value of the adhesive can be made for use desired for the substrate. The usual automobile masking tapes are useful in this invention, particularly where the jacket is primed with a primer as described hereinafter.

The thickness, coating weight, and methods of application of the permanent and removable pressure sensitive adhesive layer 25 are similar to those of known teachings or are generally from about 0.5 to about 4 mils, desirably from about 1 to about 2 mils, preferably about 1.5 mils thick.

FIGS. 7–9 illustrate the same basic arrangement as FIGS. 1–3, except that a removable pressure sensitive adhesive layer 16 is coated so as to leave a slight uncoated area or tab at 17 at the edge of the strip to assist in one getting their finger or fingernail under and removing the release liner and release coating. The tab 17 assists in grasping the face stock 44 to assist in the hinge flap bending up the face stock into the doubled back position shown in FIG. 9, which, of course, is the operative position to hold the bag closed. FIGS. 7–9 also include a formed relationship of the hinge, which might be by a heat forming for example, and is indicated by numeral 15.

Figure 12:
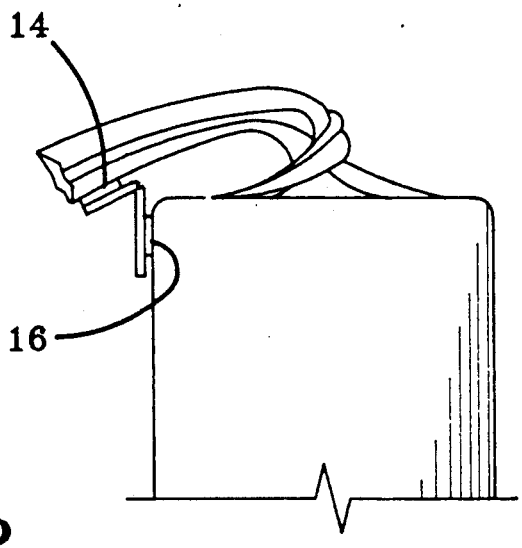
FIG. 12 illustrates a modified arrangement for positioning the twisted top of the bag to the top edge of the material which is enclosed, rather than down the side of the bag as shown in FIG. 11.

FIG. 12 illustrates the strip folded back on itself to attach to the top of the container or bag, rather than down the side as shown in FIG. 11.

Figure 4:
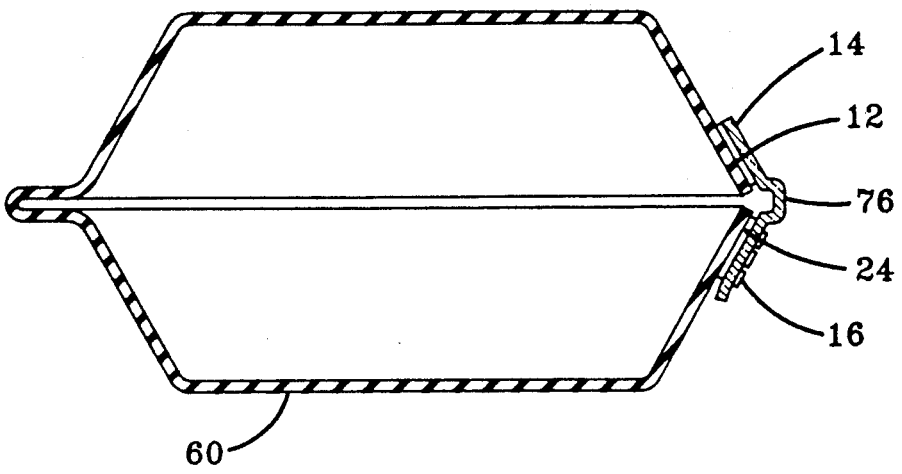
FIG. 4 is an illustration of a clam shell container with the new hinge tab closure utilized to close the clam shell.

FIG. 4 illustrates a clam shell type container 60 such as an insulated box for carrying a hamburger or the like and shows a closure strip having a permanent pressure sensitive adhesive layer attaching the top portion of the clam shell through the face stock and/or film shield to the bottom section which utilizes the removable pressure sensitive adhesive and the lift tab. Hence, one must simply grasp the lift tab and pull off the removable acting around the hinge point to allow opening of the clam shell and, of course, many times of reclosing.

Figure 5:
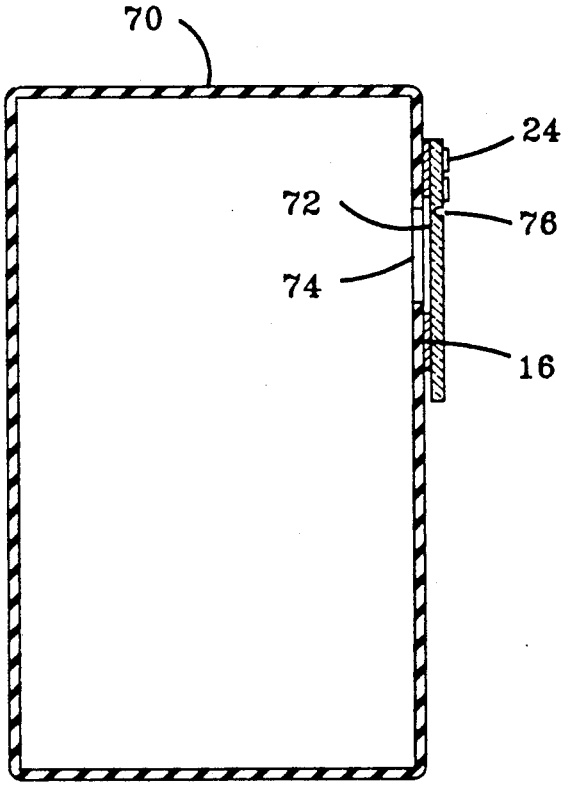
FIG. 5 shows the new hinge tab closure covering a pour opening on a box.

FIG. 5 shows the same basic structural arrangement of the closure strip attached to the side of a box 70 with the ungummed area 72 extending over the opening 74 and the removable adhesive area being below the opening 74 and providing for the reclosing. The hinge 76 is at the upper edge of the opening 74 so as to facilitate a full opening of the area 74 when the lift tab actuates the opening.

Figure 6:
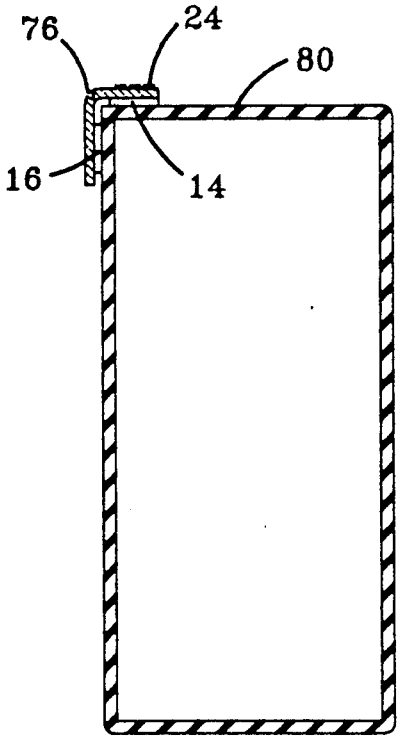
FIG. 6 illustrates the hinge tab of closure going around the corner of a box to hold a perforated flap closed.

FIG. 6 illustrates a closure strip utilized to close the top flap 80 of a box by the permanent adhesive being attached to the flap 80 and the removable adhesive being attached to the upper surface of the box. Hence, simply grasping the lift tab allows the closure strip to act to open and close the flap 80.

Figure 13:
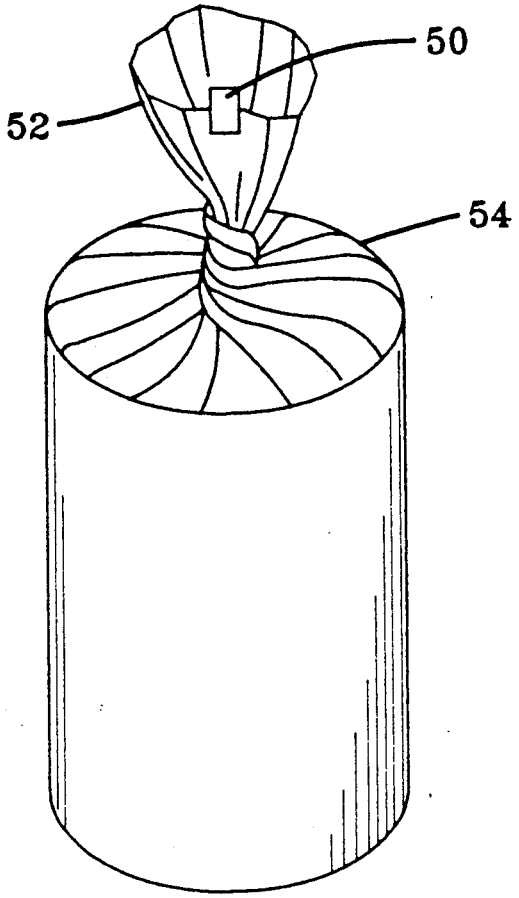
FIG. 13 is a perspective view illustrating an alternate positioning of the closure strip on the bag as extending from a top edge thereof.

FIG. 13 illustrates a modified strip 50 which is positioned so that the permanent adhesive attaches right at the very top edge 52 of a bag 54, thus making it easier to remove the liner from the removable pressure sensitive adhesive and hinge the face stock back on itself to effect the same kind of closure as shown in FIGS. 10 and 11.

It should be understood that the embodiments of the invention illustrated in FIGS. 1–3 and in FIGS. 7–9 also include the printing on the face stock which will be for advertising, promotional or instructional purposes, and this printing always stays with the product.

It should be understood that while the strip is shown as being relatively small as compared to the entire bag, it can be of variable size, but that the important features of the invention are that the pressure sensitive adhesive is on only one side of the face stock, and combines the permanent and removable adhesive in the zone coated relationship as shown in FIGS. 1–3 and 7–9. This then, of course, allows the printing to take place on the unexposed and non-pressure sensitive side of the face stock so as to provide a permanent promotional or advertising space.

Figure 14:
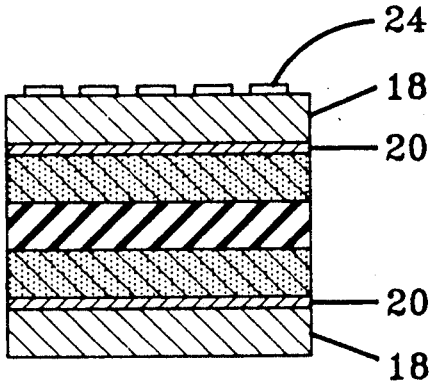
FIG-14 PRIOR ART
FIG. 14 is a cross-sectional view of the prior art closure system of pending application Ser. No. 413,951.

This should be contrasted to the prior art teaching of patent application Ser. No. 413,951 which is depicted in FIG. 14 of the drawings wherein a double faced pressure sensitive is applied around the central carrier, and while the release liner that is exposed can have printing thereon or advertising materials, once it is peeled off and thrown away, the advertising or instructional potential is lost.

Figure 15:
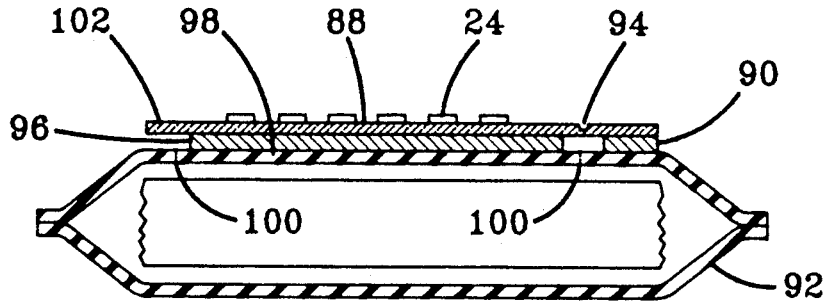
FIG. 15 is a side elevational cross-sectional view of a small container for hand cleaning towels known as handy wipes, which shows a face stock for lifting off a perfed opening in the container, but with the container in tact.
Figure 16:
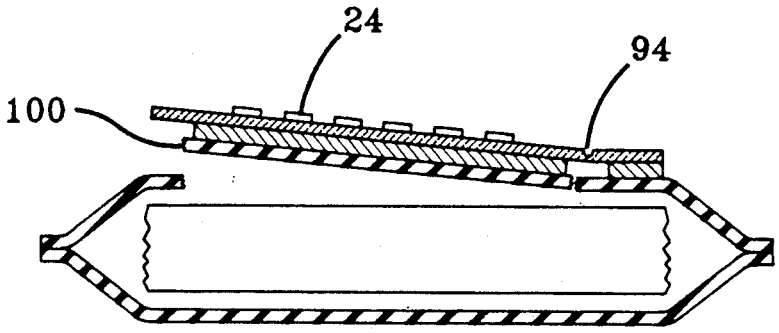
FIG. 16 is the container of FIG. 15 in the same view, but showing the lifting and perfing of the container itself as the face stock is lifted back to open up the container.
Figure 17:
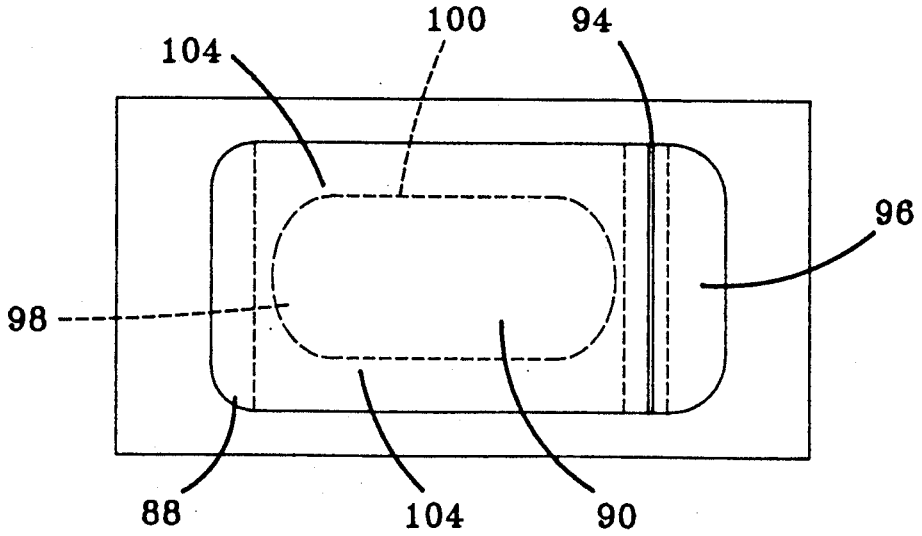
FIG. 17 is a top plan view showing the positioning of the face stock with the respective adhesive areas and the perfed relationship of the container itself.

FIGS. 15–17 illustrate a modification of the closure strip adapted to a small packet of handy wipes, for example, wherein a face stock 88 has two areas 90 and 96 of permanent adhesives, but of a different permanent adhesive. A first permanent adhesive illustrated at 90 adheres the face stock 88 permanently to the container 92. A hinged relationship is provided at 94 to facilitate a cooperation with second permanent adhesive 96 which is attached to a removable section 98 of the container 92. The removable section 98 is perfed at 100 to form a substantially rectangularly shaped removable section 98 that tears out when a lift tab 102 is grasped and pulled back in the direction shown in FIG. 16. The permanent adhesive 96 adheres the stock 88 to the section 98 so that entire section 98 tears out. The reclosable feature comes because the permanent adhesive 96 extends beyond the lateral edges of the removable section 98 and is designed for a releasable and reclosable relationship to the surfaces 104 of the container 92 at the lateral edges of the removed section 98, as seen in FIG. 17. The surfaces 104 are smooth so the permanent adhesive layer 96 is removable with respect thereto. Hence, the container 90 really can be substantially reclosed as the face stock is hinged at 94 and places the removed section 98 back into position and holds it in place by the adhesive around the lateral edges, which is best seen in FIG. 17. This type of container might contain the wetted hand towels and or sanitary napkins or the like, for reclosure and disposal if desired.

Figure 18:
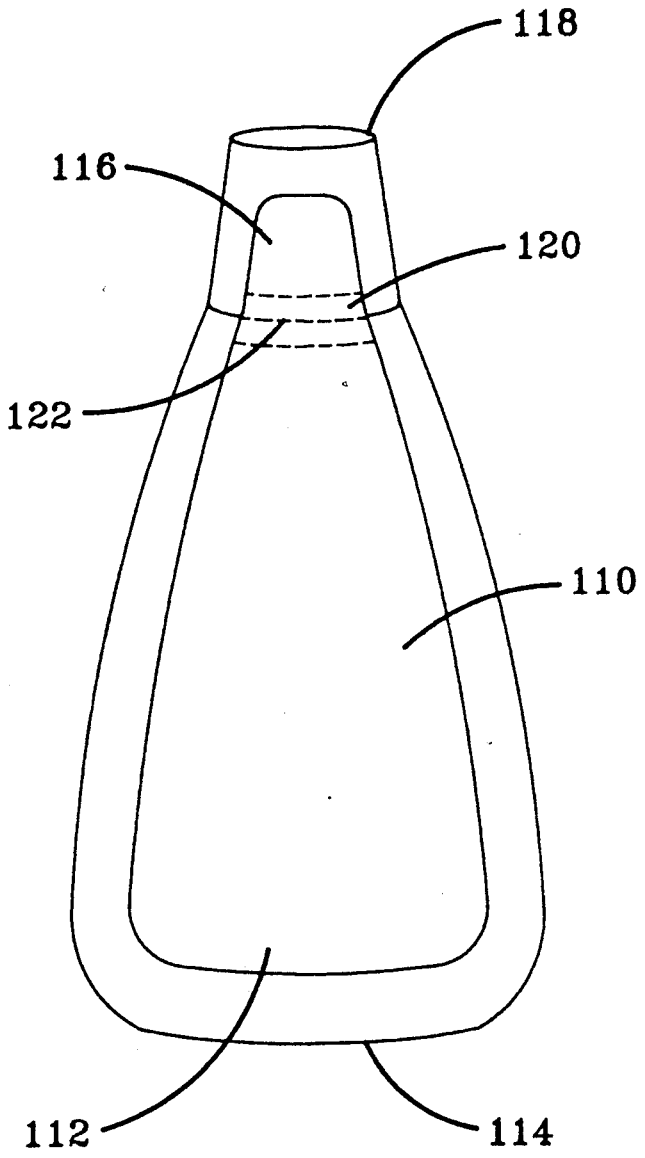
FIG. 18 is an elevational view of a container having the strip of the invention having two permanent adhesives adhered to two separate surface conditions which may be perforated in the ungummed areas at the line of intersection between the top cap and the container.

FIG. 18 is a bottle type container having a strip 110 with a first adhesive area 112 with a permanent adhesive that adheres well to a bottle surface 114 such as a polyethylene blow molded container and a second adhesive area 116 having an adhesive that may either permanently or removably adhere to a hard plastic cap 118. An ungummed area is provided at 120 which may be perfed as at 112 to facilitate tearing the label or strip 110 in half when the cap 118 is removed, or the adhesive 116 can be peeled back to removably release the cap 118.

Figure 19:
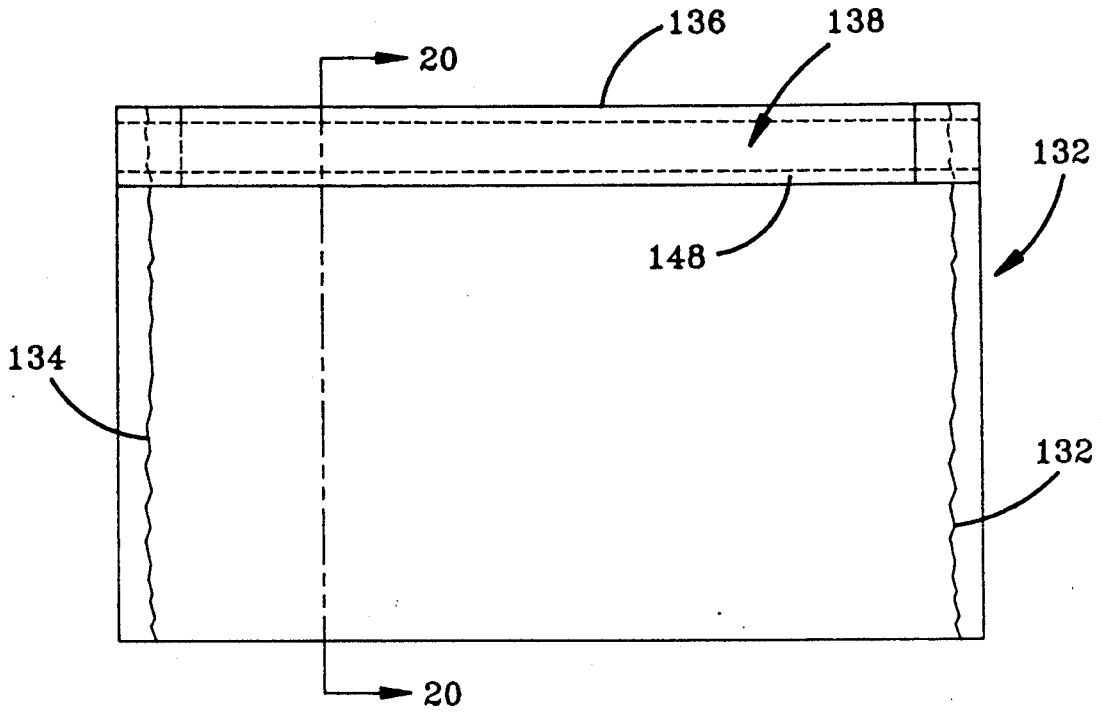
FIG. 19 is a plan view of a plastic bag which could be used to carry food showing the use of the strip of the invention for closing the lateral side of the bag.
Figure 20:
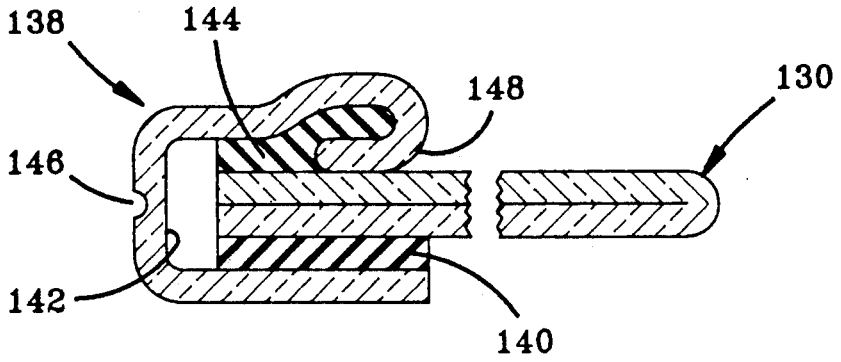
FIG. 20 is a cross-sectional view substantially enlarged taken on line 20—20 of FIG. 19, showing the particulars of the use of the strip of the invention in the closure mechanism for a food package.

Referring to FIGS. 19 and 20, the application of the strip of the invention to a food package will be explained. Specifically, the numeral 130 illustrates a food package, which normally will be made from plastic or the like, and is heat sealed top and bottom at 132 and !34 to normally seal the package. Normally, this type of package is blown in a tubular shape and cut off to the particular length so that once it is heat sealed at 132 and 134, the package is fully enclosed for such items as frozen vegetables or other food items, or the like. The modification of the package 130 contemplated herein is to slit the package down the lateral side 136 and then to utilize the strip of the invention, which is generally identified by numeral 138 in this figure, to effect the reclosure of the package after a portion of the contents are used. A better understanding of the strip 138 is seen in FIG. 20 showing that a permanent adhesive 140 attaches the strip 138 in a permanent manner to the package 130 as described previously. There is an ungummed area 142, and the removable adhesive is indicated by 144. A hinge area is indicated by 146. In this instance, a fold back tab 148 is formed on the removable adhesive side to assist in lifting up and removing the strip from the sealed relationship indicated or you may have an ungummed edge. Two perf lines or cuts 131 are formed on the side edges of the strip 138 inside the heat sealed lines 132 and 134 to allow the fold opening of the removable side of strip 138, thus giving access to the slit open edge 136 into the package 130. Again, the removable adhesive 144 allows for multiple repositioning and reclosure of the package 130 as many times as desired as the materials are taken from inside. The adhesives 140 and 144 should be of the freezer type or otherwise depending on the ingredients of the package, all of which is well understood by one skilled in the art so as to still function properly in a freezer or other environment. The tab 148 simply is the edge of the strip folded back on itself so that there is no adhesive, and it can be easily grasped between the thumb and forefinger, and the strip peeled back to actually open the package.

Figure 21:
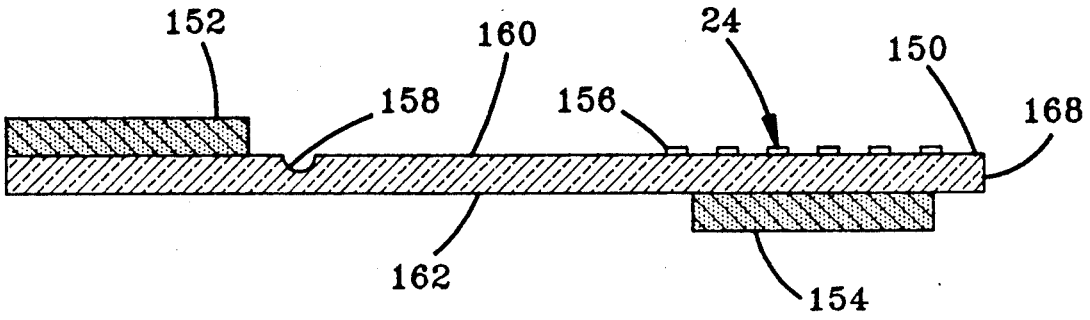
FIG. 21 is a cross-sectional elevation of a modified hinge strip which includes permanent adhesive on one side, removable on an opposite spaced location, and printing essentially opposite the removable.
Figure 21A:
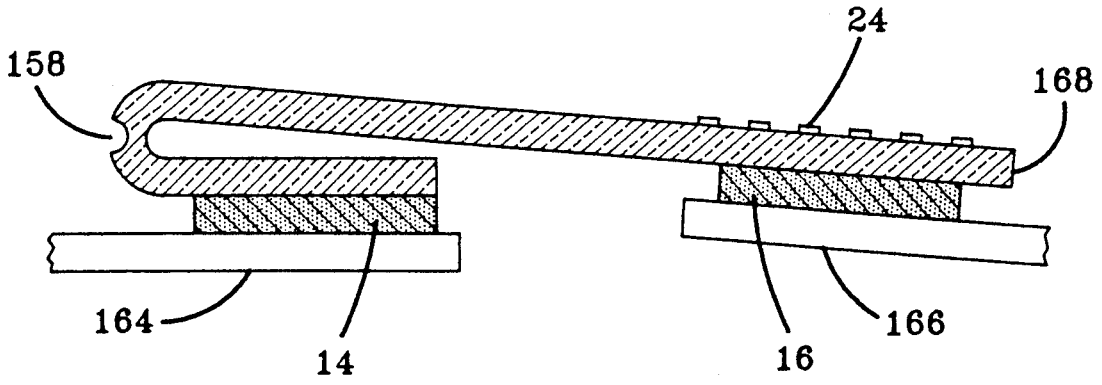
FIG. 21A illustrates the hinge strip of FIG. 21 folded back on itself into an operable position to operate as a closure showing how the permanent adhesive is attached to the container in the folded back condition, the removable is then attached to the container with the printing showing.

With reference to FIGS. 21 and 21A , the numeral 150 illustrates the face stock which incorporates a permanent adhesive at 152, a removable adhesive at 154, and printing at 156 with a hinge area at 158, and an ungummed area on the top surface indicated by numeral 160, and on the bottom surface indicated by numeral 162. This particular adaptation is designed for the permanent adhesive layer 152 to adhere to the container 164 as shown in FIG. 21A with the removable adhesive layer 154 that secured to container 164 by folding the face stock back on itself around the hinge 158 so as to have the strip act as a shield over a container opening 166. Note that the printing 156 is always exposed. A tab 168 is formed by the face stock 150 extending out past the edge of the removable adhesive 154. In this particular embodiment, the actual length and coverage of the permanent adhesive 152 as contrasted to the removable adhesive 154 can be over various sizes and with different spacings to accommodate the particular container with which this closure element is to be associated.

Figure 22:
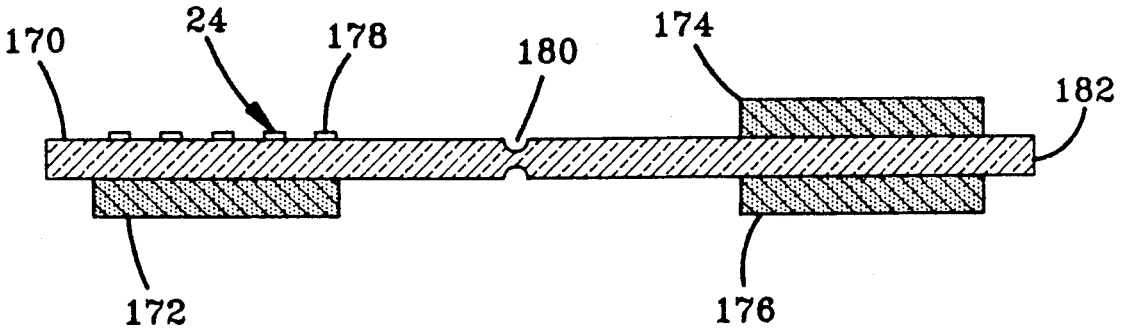
Figure 22A:
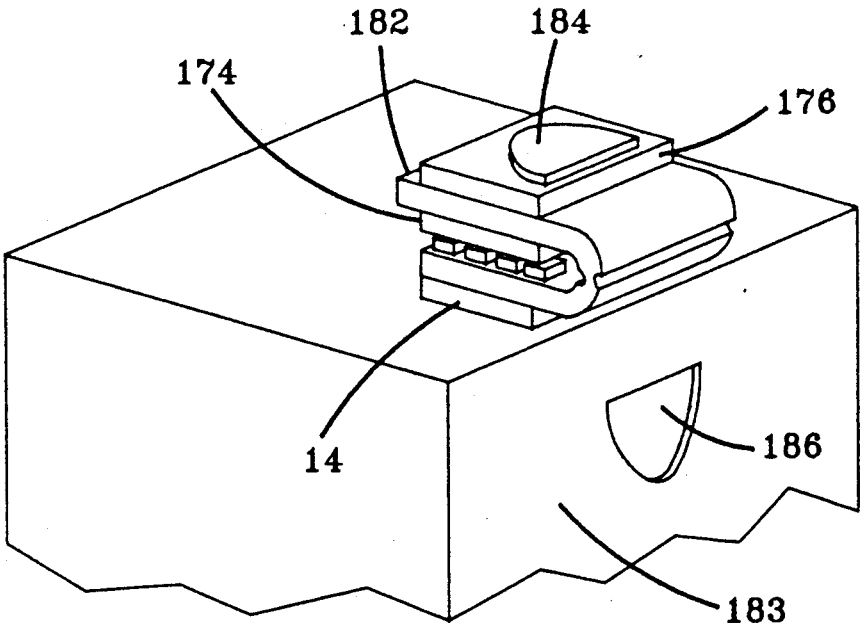
FIG. 22A illustrates the hinge strip of FIG. 22 in operable position associated with the container showing how the strip folds back on itself and adheres to itself to hold a removed box plug out of the way to allow the contents of the container to be dispersed without contaminating the removable pressure sensitive adhesive.

With reference to FIGS. 22 and 22A, in this instance the face stock is indicated by numeral 170 with the permanent adhesive indicated by numeral 172 and removable adhesive layers 174 and 176 on opposite sides of the face stock, and the printing area to 178 hinge is indicated by 180 between the printing and the top removable layer 174. A tab is formed on both sides of the face stock adjacent the removable layers 174 and 176 with the tab indicated by numeral 182. This particular hinge closure strip is perhaps best adapted for use with the container 183 illustrated in FIG. 22A wherein the lower removable pressure sensitive layer 176 contacts with and pulls out a box plug 184 from the container exposing a container opening 186, in the manner to allow the contents which might be soap, grass seed, etc., for example, to be poured out the opening 186. In order to prevent the pressure sensitive layer 176 from becoming contaminated by the soap as it is poured out, the removable adhesive layer 174 is folded back in the configuration illustrated in FIG. 22A and pressed into retain position on top of the printing 178, thus holding the entire closure hinge mechanism out of the way and allowing the soap powder to be poured from the opening 186. When it is desired to reclose the container, one simply grasps the tab 182 and removes layer 174 from the printing area 178 and then reapplies the extending adhesive layer 17 to push the box plug 184 back into position and hold it relative to the container 183. The box plug 184 will be perforated and removed in very much the same manner as described with respect to FIGS. 15–17 of the drawings, and again the removable pressure sensitive adhesive layer 176 will extend laterally past the sides of the opening 186 so as to removably and repeatedly reclose the container.

Figure 23:
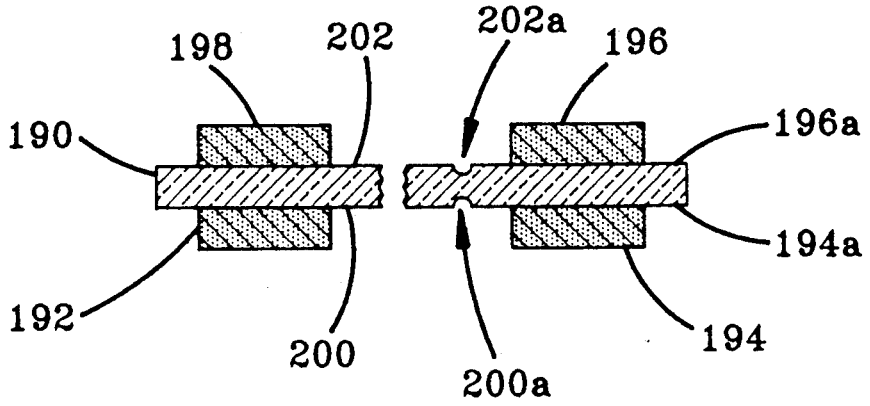
FIG. 23 is an enlarged cross-sectional elevational diagram of another embodiment of the hinge strip of the invention illustrating that a permanent adhesive or heat seal is on one end and surface, but that a plurality of other combinations of removable adhesive, permanent adhesive, or printing can be associated with the other three surfaces of the strip to achieve the desired objects.

FIG. 23 is an illustration of the great flexibility and variations that can be incorporated into the hinge strip closure mechanism of the invention. Numeral 190 illustrates a face stock and/or film shield which might be thin and flexible plastic, or thicker more rigid material depending upon the particular circumstances. In any event, the essence of the invention is accomplished by including a permanent adhesive or heat seal indicated by 192 that will permanently attach the face stock 190 to the container. Three additional zones are contemplated, these being indicated by numerals 194, 196 and 198, and each of these zones or areas can be either a removable adhesive, a permanent adhesive, or simply be printing depending upon the particular closure mechanism characteristics desired at the particulars of the container with which this is associated. The criticality of the invention, however, is to include ungummed area between each of the respective sections, these being respectively indicated by numeral 200 on the bottom, and 202 on the top. The exact spaced relationship of the ungummed areas between areas 196 and 198 and 192 and 194, respectively can vary again depending upon the particulars of the closure mechanism and the container with which it is associated. Each of the ungummed areas 200 and 202 may include a hinge relationship which is illustrated at 200*a* on the bottom and 202*a* on the top, and again it should be understood that these hinged areas can be positioned anywhere in the ungummed area relative to the respective pressure sensitive adhesive and/or printed areas. Preferably, some ungummed area is provided at the ends of the film stock 190 adjacent to the areas 194 and 196 so as to form respective tabs 194*a* and 196*a*.

Thus, it should be understood that the exact size of the respective areas 192 through 198, as well as their positional relationship on the face stock 190 can all vary depending upon the particulars of the container which is being closed. When we refer to permanent adhesive associated with areas 194, 196 or 198, it should be understood that that will actually be removable from the area of the container to which it is attached because the entire unit must, in fact, be repeatedly removable to effect a reclosure of the container, and the only adhesive which remains in tact and holds the face stock always with respect to the container is the permanent adhesive or heat seal area 192. It should further be understood that there could be both printing and pressure sensitive adhesive in areas 194, 196 and 198, again depending upon the need for the closure system and whether or not the face stock 190 is clear or opaque.

It should further be understood that this invention is applicable to either being in a tape roll or a self wound configuration during manufacture. Also, it can be used in sheet label or sheet form. The hinge tab closure system can be die cut in various sizes and shapes. The spacing between the permanent pressure sensitive and removable pressure sensitive can vary depending upon the desired action of the hinge and the necessity of not attaching to a portion of the product, such as over the carton opening configuration shown in FIG. 5. It should be understood that the face stock may be clear or opaque and may include printing on one or both sides of the clear or on one side of the opaque. The pressure sensitive adhesive may be pigmented such as in a red to identify the release tab to the user. The red pigment in the adhesive may also act as a warning or as a protective label to identify to the user that this is a release tab and should be used as a closure system.

It should further be understood that in certain instances it may be desirable to use a heat seal in place of the permanent adhesive to the package, in which case it would not be necessary to utilize a permanent adhesive, but the heat seal itself would act as the permanent attachment of the tab. Finally, it should be understood that the closure strip or shield can employ any type of thickness or stiffness in the face material so as to facilitate the hinging action, and that the hinging action may be at one or more points in the middle so as to bend around a large radius corner or work more acceptably in the clam shell arrangement as shown in FIG. 4.

While in accordance with the patent statutes, only the preferred embodiment of the invention has been illustrated and described in detail, it is to be particularly understood that the invention is not limited thereto or thereby, but that the inventive scope is defined in the appended claims.

What is claimed is:

1. A reclosable container having a reclosable system to close an opening therein including a reclosing member positioned on the container and having first and second pressure sensitive adhesive surfaces on one side of said member;

at least a portion of said first surface comprising an active first pressure sensitive adhesive layer bonding to said container with a permanent pressure sensitive adhesive strength;

said second surface comprising an active second pressure sensitive adhesive layer bonding to said container with a removable pressure sensitive adhesive strength;

wherein a non-adhesive area is positioned between the first and second active pressure sensitive adhesive layers whereby when member is pulled so that the second layer is peeled from a position of adherence to the container towards a position of non-adherence, it snaps across the non-adhesive area to serve as an indicator of sufficient peeling of the second layer from the container.

2. A reclosable closure system according to claim 1 wherein at least two areas of pressure sensitive adhesive may attach to said container on different planes.

3. A reclosable closure system for a container according to claim 2 wherein the two separated areas of pressure sensitive adhesive are a permanent adhesive where the areas are adapted to be permanently attached to the container and a removable adhesive where the areas are adapted to be repeatedly removably attached to the container.

4. A reclosable closure system for a container according to claim 1 which includes an ungummed area between the separated areas of pressure adhesive and wherein the ungummed area covers the opening in the container.

5. A reclosable closure system for a container according to 1 wherein the removably attached pressure sensitive adhesive area is permanently attached to a perforated cut portion of the container which pulls out to expose the opening when the face material containing such pressure sensitive adhesive area is pulled.

6. A reclosable closure system for a container according to claim 1 which includes a lift tab associated with a face of the container in connection with the area of pressure sensitive adhesive that is repeatedly removably attached to the container.

7. The reclosable closure system according to claim 1 wherein said adhesive is selected from the class consisting of a rubber base adhesive and an acrylic base adhesive having aggressive initial adhesion characteristics after which growth is inhibited to form a non-permanent bond.

8. A reclosable closure system for a container according to claim 1 wherein said removable adhesive is an acrylic base adhesive having aggressive initial adhesion characteristics after which growth is inhibited to form a non-permanent bond.

9. A reclosable closure system for a container according to claim 1 wherein at least one area of first adhesive strength is attached to said container and a face material is folded back on itself such that an area of second adhesive strength can be removably attached to said container.

10. A reclosable closure system for a container claim 1 wherein said system further comprises a hinge means associated with a face material and located between at least said first layer of pressure sensitive adhesive and said second layer of pressure sensitive adhesive.

11. A reclosable closure system according to claim 10 wherein said hinge means is formed on the reclosing member in the separation between the first and second pressure sensitive layer.

12. A reclosable closure system for a container according to claim 11 wherein the hinge means is heat formed into the reclosing member.

13. A reclosable container according to claim 1 which includes a release liner positioned on said second surface to protect said adhesive layer until use of the reclosure member is desired; and whereby removal of at least a portion of said release liner exposes said second adhesive layer allowing the layer adhered to the container to close said opening.

14. A method of repeatedly closing an essentially flexible container having at least one opening therein comprising the steps of:

affixing a reclosing strip member to the flexible container in cooperation with the opening, said strip member having on the same side at least two areas of pressure sensitive adhesive attached and separated by a non-adhesive area wherein at least one area is adapted to be permanently attached to the container, and at least a second area is adapted to be repeatedly removably attached to the container;

whereby when the second area of the strip member is peeled from a position of adherence to the container towards a position of non-adherence, it snaps across the non-adhesive area to serve as an indicator of sufficient peeling of the second area from the container.

15. A method of repeatedly closing a container according to claim 14 wherein the step of affixing the strip may be done at a plurality of sites on said container.

16. A method of repeatedly closing a container according to claim 14 wherein;

said reclosing strip further comprises a hinge means associated with the face material in the separation between the areas of pressure sensitive adhesive and the step of affixing permits the strip to be positioned on the container on different planes to close and expose said opening.

17. A method of repeatedly closing a container according to claim 16 wherein;

said strip further comprises an ungummed area between the separated areas of adhesive to cause said ungummed area to rest over the opening of said container in closed position.

18. The closure system method for a container according to claim 17 wherein a first portion of said area of second adhesive strength is attached to a perforated cut portion of the container which pulls out when the face material containing such pressure sensitive adhesive is pulled out to open the container.

19. A method according to claim 14 with the second area containing the repeatedly removable adhesive being covered with a release liner;

removing the release liner from the second area of said reclosing strip member, thereby exposing the non-permanent reclosable adhesive;

substantially closing said open end of said container; and attaching said open end to a site on said container by means of said reclosing strip member to thereby maintain the substantially closed position of said open end.

* * * * *